US007363874B1

(12) United States Patent
Arne

(10) Patent No.: US 7,363,874 B1
(45) Date of Patent: Apr. 29, 2008

(54) FLAG DISPLAY APPARATUS

(76) Inventor: Kevin D. Arne, N5234 Cty. Rd. Y, Oakfield, WI (US) 53065

( * ) Notice: Subject to any disclaimer, the term of this patent is extended or adjusted under 35 U.S.C. 154(b) by 119 days.

(21) Appl. No.: 11/372,887

(22) Filed: Mar. 10, 2006

(51) Int. Cl.
*G09F 17/00* (2006.01)

(52) U.S. Cl. ..... 116/173; 116/63 P

(58) Field of Classification Search ..... 116/173, 116/174, 63 P; 40/602, 603, 604, 606.13, 40/606.14, 606.17
See application file for complete search history.

(56) References Cited

U.S. PATENT DOCUMENTS 1,254,524 A * 1/1918 Mink ..... 116/173
2,225,103 A * 12/1940 Einermann ..... 116/173
2,655,126 A * 10/1953 Francis ..... 116/173
2,954,626 A * 10/1960 Kies ..... 40/604
3,183,886 A 5/1965 Moffitt
3,200,786 A * 8/1965 Swezy et al. ..... 116/63 P
3,219,010 A * 11/1965 Hyatt ..... 116/173
3,288,412 A * 11/1966 Murphy ..... 248/125.2
3,396,695 A * 8/1968 Milburn ..... 116/173
4,592,158 A * 6/1986 Seely ..... 40/603
4,960,067 A * 10/1990 Currie ..... 116/28 R
5,152,091 A * 10/1992 Leach ..... 40/603
5,427,050 A 6/1995 Horn
D409,950 S 5/1999 Cursage
6,923,141 B1 * 8/2005 Staats et al. ..... 116/173

FOREIGN PATENT DOCUMENTS

JP 2002182596 A * 6/2002

* cited by examiner

*Primary Examiner*—R. Alexander Smith
(74) *Attorney, Agent, or Firm*—Brannen Law Office, LLC

(57) ABSTRACT

The present invention relates to an improved flag display apparatus useful for displaying a selected portion of the front of the flag. The apparatus has a demonstrator with a first positioner at the first end of the demonstrator and a second positioner at the second end of the demonstrator. The first and second positioners can be cartridges containing selected lengths of adhesive material, or alternatively be made of high friction material. The demonstrator can be linearly and angularly adjustable. The apparatus can comprise a stabilizer for fixing the demonstrator relative to the pole. The stabilizer can comprise a string or other material that can wind around the pole to fix the demonstrator to the pole. Alternatively, the stabilizer can comprise a clamp or a string depending from the top clip of the pole.

18 Claims, 11 Drawing Sheets

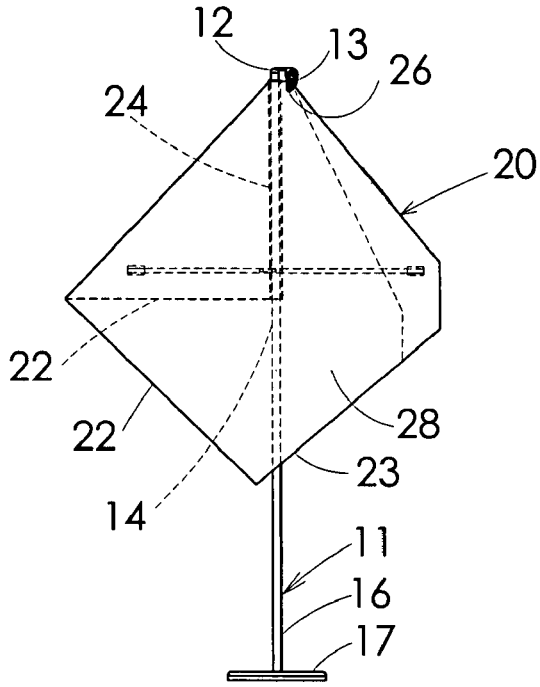
FIG 1 - PRIOR ART
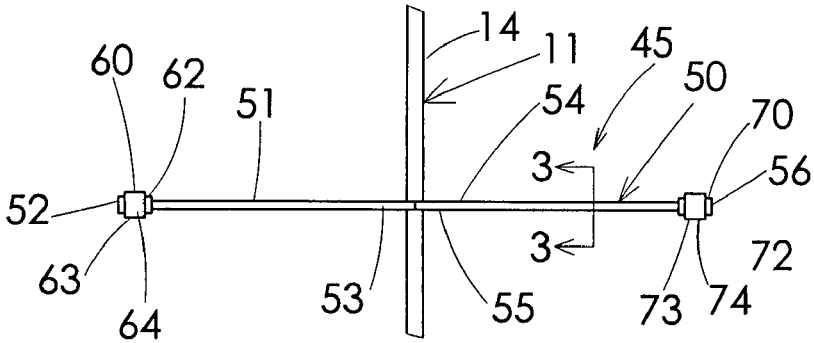
FIG 2
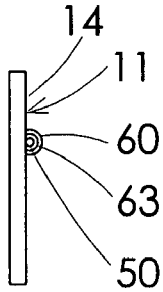
FIG 3

FLAG DISPLAY APPARATUS

BACKGROUND OF THE INVENTION

1. Field of the Invention

The present invention relates to a flag display apparatus useful in displaying a flag wherein a selected portion of the center of the front of the flag can be displayed.

2. Description of the Related Art

Flags have been in existence for many years. It is customary to use a conventional stand alone upright flag pole to display the flags. The flag is connected to the flag pole, and drapes down there from. Generally, the flag poles and corresponding flags come in two configurations. In one configuration, the pole has two clips, one at the top of the pole and one at the mid-section of the pole. The flag for use with this type of pole has a top eyelet at the top left corner of the flag, and a bottom eyelet at the bottom left corner of the flag. The two clips of the pole can be connected to eyelets of the flag to hold the flag in an intended position upon the pole.

In a second configuration, the flag pole has a top with an eyelet at the top. The flag for use with this type of pole generally has a sleeve along the left side for receiving the top section of the pole. The flag further has an eyelet through the top left corner of the flag for the clip to connect to.

Some flag displays use a rigid bar across the top of the flag to display the entire flag. Such an apparatus may work well for its intended purposes, but it has some drawbacks associated with it. A flag display apparatus of this type may be impractical for use with anything but a relatively small flag. Large flags may have a length of more than four feet, and the weight of the flag could tip the flag pole unless it is anchored into the ground or floor. Undesirably, anchoring the flag pole to the ground or floor limits the mobility of the flag pole and flag and can require permanent alterations to the floor.

Another apparatus, such as the one shown in U.S. Pat. No. 5,427,050 to Horn, shows a system for producing a wave motion in flags and other insignia. This patent teaches the use of an air blower in combination with the flag and flag pole. While this combination may work well for its intended purposes, its application is somewhat limited. It may be undesirable to use a powerful fan in indoor applications, as the resulting breeze and noise from the fan may be distracting. Alternatively, when using a less powerful fan so as not to disrupt the indoor environment, the fan may only work as intended with a relatively small flag. Further, the blower requires an energy source, such as a battery or electrical connection to a wall socket.

One solution to this problem was developed by the inventor of the present invention, wherein a rod was provided having the adhesive surface of tape present on each end. FIG. 1 shows this design. The user could adhesively secure the tape within a flag as it depends from the pole. While this design solved many of the problems noted above, its design could be improved upon. The tape at the ends of the rod may lose their adhesive qualities over time. This could lead to the rod falling from the flag at an inopportune time. The tape at the ends of the rod therefore needs frequent replacement, and suitable tape may not be readily available for replacement. Having a lack of suitable tape available for replacement could render the device useless for its intended purpose.

Thus there exists a need for a flag display apparatus that solves these and other problems.

SUMMARY OF THE INVENTION

The present invention relates to an improved flag display apparatus useful for displaying a selected portion of the front of the flag.

This can be accomplished in one embodiment by having a demonstrator having adhesive cartridges at its ends, wherein used or worn adhesive tape can be removed after a single use. Removing a layer of adhesive tape from each cartridge exposes a fresh layer of adhesive useful for the next application. Fresh tape suitable for adhering to a flag is advantageously always available within the cartridge. This eliminates the possibility that fresh adhesive material is unavailable.

This can also be accomplished through the use of an adjustable demonstrator. Use of an adjustable demonstrator allows the user to select the desired portion of the flag to display. One adjustable demonstrator linearly adjusts in length. Changing the length and location of the demonstrator can alter the display characteristics of the flag.

This can further be accomplished by having a stabilizer that fastens the demonstrator to the pole. Fastening the demonstrator to the pole eliminates the chance that the demonstrator can fall from within the flag. Suitable stabilizers can include bands or pieces of hook and eye fabric which are used to fix the stabilizer to the pole.

This can still further be accomplished by having the demonstrator be fixed in relation to the pole in a manner where it is fixed generally perpendicular to the pole. This could be accomplished by using a clamp or a string depending from the clip atop of the flag pole. Advantageously, the demonstrator need not be centered with respect to the pole. In this regard, the demonstrator can retain its orientation with respect to the pole regardless of how far the center of gravity of the demonstrator is adjustably offset from the pole.

In the embodiments where the demonstrator is connected to the pole, the ends of the demonstrators can be made of high friction material instead of adhesive material. The weight of the flag that is draped over the demonstrator will keep the flag in place.

A further desirable attribute is if the fixed bar is angularly adjustable. This can be accomplished by having a demonstrator that is angularly adjustable at both ends relative to the stabilizer.

Advantageously, in all embodiments, the center of the flag can be displayed. Use of the display apparatus of the present invention is done without alteration of the flag. Further, no electricity is needed in order to display flags using the present invention.

Other advantages, benefits, and features of the present invention will become apparent to those skilled in the art upon reading the detailed description of the invention and studying the drawings.

BRIEF DESCRIPTION OF THE DRAWINGS

FIG. 1 is a front view of an existing product.

FIG. 2 is a front view of a preferred embodiment of the present invention.

FIG. 3 is a cross-sectional end view of the preferred embodiment shown in FIG. 2 taken along line 3-3.

DETAILED DESCRIPTION OF THE PREFERRED EMBODIMENTS

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 9:
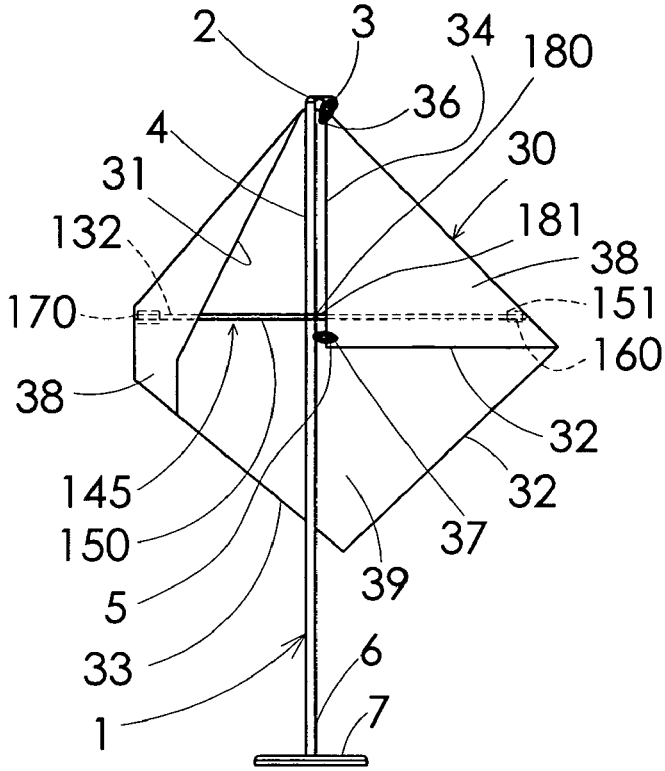
FIG. 9 is a rear view of the preferred embodiment shown in FIG. 6 holding a flag in a selected position.

One example of a flag pole 1, such as the pole 1 shown in FIG. 9, that is useful with the present invention is a stand alone upright pole having a top 2, a middle 4 and a bottom 6. A clip 3 is at the top 2 of the pole. A clip 5 is also located at the middle 4 of the pole. The bottom 6 of the pole 1 can be inserted into a base 7. The base generally has a bottom that lies flush on a surface, such as a floor. The pole 1 can be made of any suitable rigid material, such as aluminum or wood. Preferably, the pole 1 stands about 7-8 feet tall. There is preferably about 4 feet between the top clip 3 and the middle clip 5.

A flag 30 can be used with pole 1. When looking at the flag 30 from the front, the flag has a top 31, and a bottom 32, a right side 33 and a left side 34. The top 31, bottom 32, right side 33 and left side 34 define a flag size that is preferably rectangular. One preferred size is 4 feet in height by 6 feet in length. However, it is understood that other sizes can be used with the present invention without departing from the broad aspects of the present invention. A first eyelet 36 is through the flag 30 on the left side 34 near the top 31. A second eyelet 37 is through the flag 30 on the left side 34 near the bottom 32. The flag 30 has a front surface 38 and a rear surface 39. Images, text, etc. can be located at various locations on the front surface 38 of the flag 30.

Flag 30 can be supported by pole 1. In this regard, the top eyelet 36 can be connected to the top clip 3, and the bottom eyelet 37 can be connected to the bottom clip 5. The left side 34 of the flag remains generally vertical and parallel to the pole 1 when the flag 30 is supported by the pole in this manner.

Another example of a flag pole 11 useful with the present invention is a stand alone upright pole having a top 12, a middle 14 and a bottom 16. A clip 13 is at the top 12 of the pole. The bottom 16 of the pole 11 can be inserted into a base 17. The base generally has a bottom that lies flush on a surface, such as a floor. The pole 11 can be made of any suitable rigid material, such as aluminum or wood. Preferably, the pole 11 stands about 7-8 feet tall.

A flag 20 can be used with pole 11. When looking at the flag 20 from the front, the flag has a top 21, and a bottom 22, a right side 23 and a left side 24. The top 21, bottom 22, right side 23 and left side 24 define a flag size that is preferably rectangular. One preferred size is 4 feet in height by 6 feet in length. However, it is understood that other sizes can be used with the present invention without departing from the broad aspects of the present invention. A first eyelet 26 is through the flag 20 on the left side 24 near the top 21. A sleeve 27 is preferably at the left side 24 of the flag between the top 21 and bottom 22. The flag 20 has a front surface 28 and a rear surface 29. Images, text, etc. can be located at various locations on the front surface 28 of the flag 20.

Flag 20 can be supported by pole 11. In this regard, the sleeve 27 can be placed over and around the top 12 of the pole 11, and the eyelet 26 can be connected to the top clip 13. The left side 24 of the flag remains generally vertical and parallel to the pole 11 when the flag 20 is supported by the pole in this manner.

Looking now to FIGS. 2-5, a preferred embodiment 45 of the present invention is shown. The preferred embodiment has a demonstrator 50 comprising a first piece 51 and a second piece 54. The first piece 51 has a first end 52 and a second end 53. The second piece 54 has a first end 55 and a second end 56. The second end 53 of the first piece 51 is preferably linearly adjustably connected to the first end 55 of the second piece 54. In this regard, the first and second pieces 51 and 54 can be telescopically connected in a twistable, linearly slideable, or other manner. The first and second pieces 51 and 54 are preferably made of a rigid and light-weight material, such as tubular aluminum, wood or plastic. However, it is understood that the first and second pieces 51 and 54 of the demonstrator 50 can be made of other materials without departing from the broad aspects of the present invention. The demonstrator 50 is shown to be generally round in the illustrated embodiment. However, it is understood that the demonstrator 50 could have other profiles, such as rectangular, without departing from the broad aspects of the present invention.

A first positioner is provided and preferably comprises a first cartridge 60. The first cartridge 60 has an interior surface and an exterior surface 62. The interior surface preferably defines an opening through the cartridge 60. The exterior surface 62 is preferably generally circular in profile. However, it is understood that the profile could have different shapes without departing from the broad aspects of the present invention. A selected length of adhesive material 63 is preferably wound around the exterior surface 62 of the cartridge 60. The adhesive material 63 has an adhesive surface 64 that is located on the side of the adhesive material that is away, or remote from, the cartridge 60. The selected length of the adhesive material is long enough to wind around the cartridge 60 at least two times, and preferably is long enough to provide for many revolutions. A worn or used segment, preferably one revolution, of the adhesive material 63 can be removed from the cartridge 60 to expose a fresh segment of the adhesive material 63.

The first cartridge 60 is removably connected to the first end 52 of the first piece 51 of the demonstrator 50. In this regard, the interior surface of the cartridge 60 is shaped to mate with the first end 52 of the first piece 51. The cartridge 60 can be frictionally held in place on the first end 52 of the first piece 51. Alternatively, the cartridge 60 could be pinned in place or secured in any other suitable manner.

A second positioner is also provided and comprises a second cartridge 70. The second cartridge 70 has an interior surface and an exterior surface 72. The interior surface preferably defines an opening through the cartridge 70. The exterior surface 72 is preferably generally circular in profile. However, it is understood that the profile could have different shapes without departing from the broad aspects of the present invention. A selected length of adhesive material 73 is preferably wound around the exterior surface 72 of the cartridge 70. The adhesive material 73 has an adhesive surface 74 that is located on the side of the adhesive material that is away, or remote from, the cartridge 70. The selected length of the adhesive material is long enough to wind around the cartridge 70 at least two times, and preferably is long enough to provide for many revolutions. A worn or used segment, preferably one revolution, of the adhesive material 73 can be removed from the cartridge 70 to expose a fresh segment of the adhesive material 73.

The second cartridge 70 is removably connected to the second end 56 of the second piece 54 of the demonstrator 50. In this regard, the interior surface of the cartridge 70 is shaped to mate with the second end 56 of the second piece 54. The cartridge 70 can be frictionally held in place on the second end 56 of the second piece 54. Alternatively, the cartridge 70 could be pinned in place or secured in any other suitable manner.

The adhesive material 63 and 73 of the first and second cartridges 60 and 70, respectively, act as stabilizers to fix the demonstrator within the flag 20.

Figure 4:
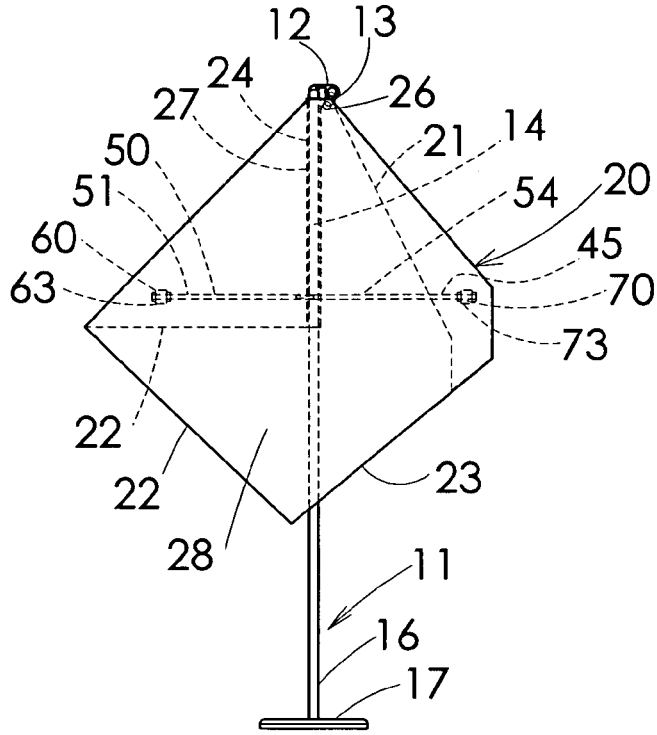
FIG. 4 is a front view of the preferred embodiment shown in FIG. 2 holding a flag in a selected position.
Figure 5:
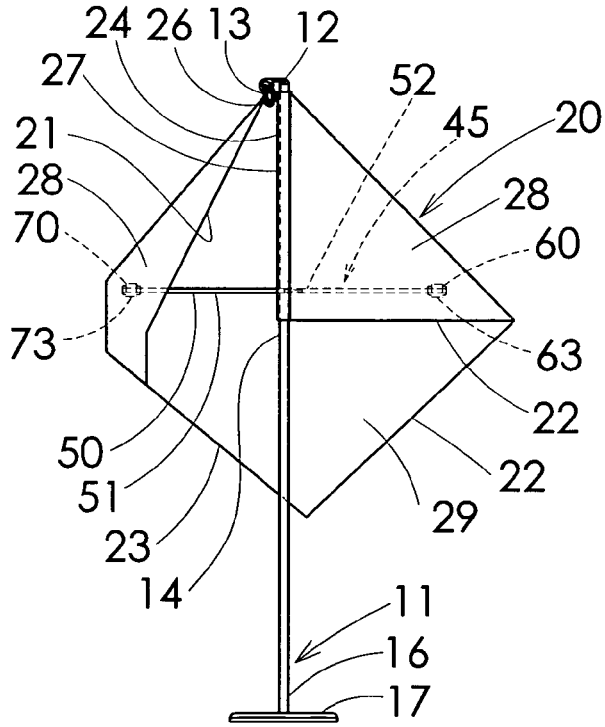
FIG. 5 is a rear view of the preferred embodiment shown in FIG. 2 holding a flag in a selected position.
Figure 6:
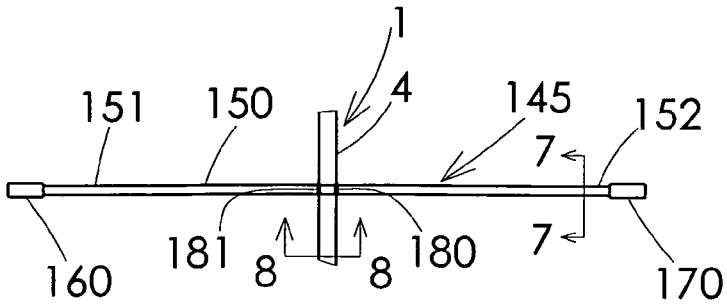
FIG. 6 is a front view of an alternative preferred embodiment of the present invention.
Figure 7:
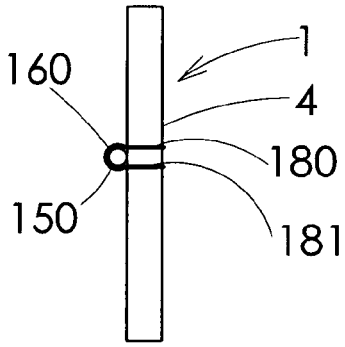
FIG. 7 is a cross-sectional end view of the preferred embodiment shown in FIG. 6 taken along line 7-7.
Figure 8:
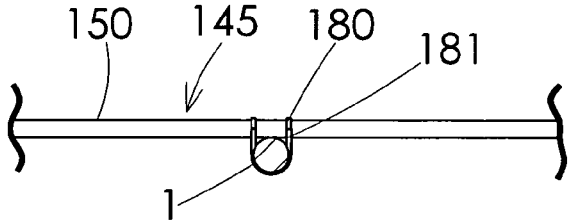
FIG. 8 is a cross-sectional top view of the preferred embodiment shown in FIG. 6 taken along line 8-8.

Turning now to the use of this first preferred embodiment 45, and looking particularly at FIGS. 4 and 5, selected portions of the front surface 28 of a flag 20 can be displayed. In the illustrated embodiment, flag 20 is supported by pole 11. Knowing which portions of the flag 20 are to be displayed, the user can select the appropriate length of the demonstrator 50, and can determine where to position the demonstrator 50 relative to the pole 11. With fresh segments of adhesive material 63 and 73, the demonstrator is inserted into the flag 20, and adhesively held within the flag. The adhesive material 63 of the first cartridge 60 is sandwiched between two portions of the back surface 29 of the flag. The first cartridge 60 is located near the bottom 22 of the flag 20, and the front surface 28 is draped over the cartridge 60. The geometry of the flag over the first piece 51 of the demonstrator 50 generally shaped as a downwardly opening pocket. The adhesive material 73 of the second cartridge 70 is also sandwiched between two portions of the back surface 29 of the flag. The geometry of the flag over the second piece 54 of the demonstrator is generally defined as a folded flag. The top 21 of the flag 20 is draped over the second cartridge 70. In the illustrated embodiment, the demonstrator 50 is generally perpendicular to the pole 11. However, other orientations of the demonstrator 50 relative the pole 11 are possible. The lowest displayed point of the flag 20 is the bottom right corner of the flag.

Looking now to FIGS. 6-9, an alternative preferred embodiment 145 of the present invention is shown. The preferred embodiment has a demonstrator 150 comprising a rod having a first end 151 and a second end 152. The demonstrator 150 is preferably made of a rigid and light-weight material, such as tubular aluminum, wood or plastic. However, it is understood that the demonstrator 150 can be made of other materials without departing from the broad aspects of the present invention. The demonstrator 150 is shown to be generally round in the illustrated embodiment. However, it is understood that the demonstrator 150 could have other profiles, such as rectangular, without departing from the broad aspects of the present invention.

A first positioner is provided and is preferably a first friction cap 160. The friction cap 160 is preferably made of rubber, but other materials can be used without departing from the broad aspects of the present invention. The first friction cap 160 is preferably permanently secured to the first end 151 of the demonstrator 150. The first friction cap 160 preferably has a generally circular profile. However, other profiles could be used without departing from the broad aspects of the present invention.

A second positioner is also provided and is preferably a second friction cap 170. The friction cap 170 is preferably made of rubber, but other materials can be used without departing from the broad aspects of the present invention. The second friction cap 170 is preferably permanently secured to the second end 152 of the demonstrator 150. The second friction cap 170 preferably has a generally circular profile. However, other profiles could be used without departing from the broad aspects of the present invention.

A stabilizer 180 is provided according to another aspect of the present invention. The stabilizer 180 preferably comprises a string 181 or band or clip of material made from rubber or plastic. The string 181 wraps around the demonstrator 150 and the pole 1.

Turning now to the use of this alternative preferred embodiment 145, and looking particularly at FIG. 9, selected portions of the front surface 38 of a flag 30 can be displayed. In the illustrated embodiment, flag 30 is supported by pole 1. Knowing which portions of the flag 30 are to be displayed, the user can determine where to position the demonstrator 150 relative to the pole 1. The stabilizer 180 fixes the demonstrator 150 in the selected position relative to the pole 1. The demonstrator 150 remains fixed to the pole until a user selectably removes the stabilizer 180. The first positioner 160 is sandwiched between two portions of the back surface 39 of the flag. The first positioner 160 is located near the bottom 32 of the flag 30, and the front surface 38 is draped over the friction cap 160. In this regard, the geometry of the flag over the first positioner 160 is a downward facing pocket. The second positioner 170 is also sandwiched between two portions of the back surface 39 of the flag. The top 31 of the flag 30 is draped over the second friction cap 170. The geometry of the flag over the second positioner 170 is a folded flag. In the illustrated embodiment, the demonstrator 150 is generally perpendicular to the pole 1. However, other orientations of the demonstrator 150 relative the pole 1 are possible. The lowest displayed point of the flag 30 is the bottom right corner of the flag.

Figure 10:
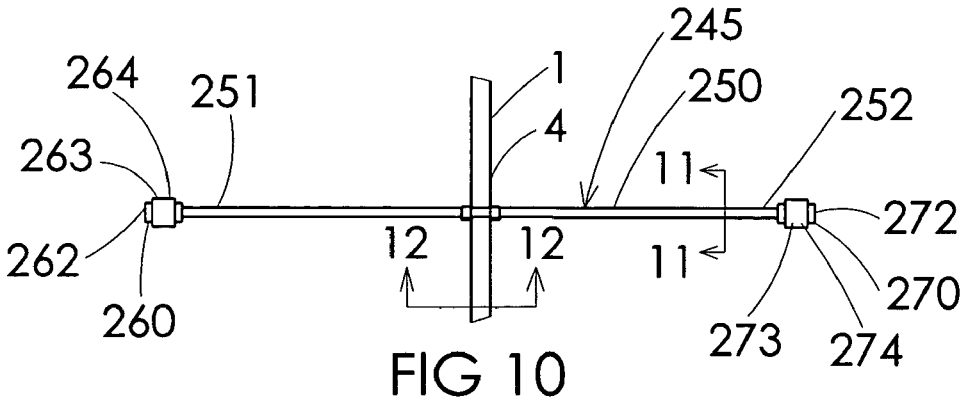
FIG. 10 is a front view of an alternative preferred embodiment of the present invention.
Figure 11:
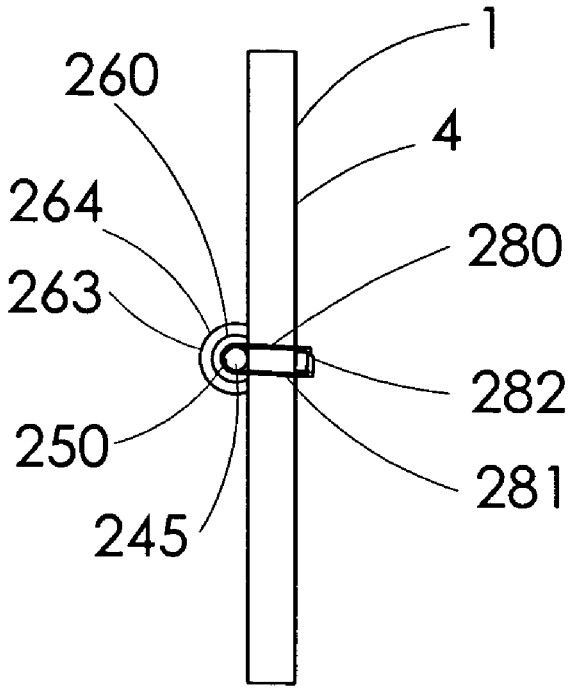
FIG. 11 is a cross-sectional end view of the preferred embodiment shown in FIG. 10 taken along line 11-11.
Figure 12:
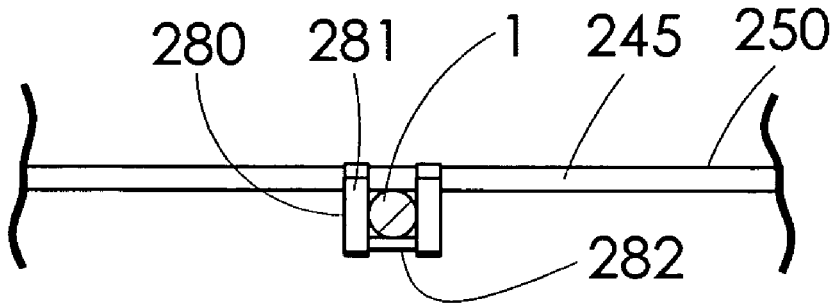
FIG. 12 is a cross-sectional top view of the preferred embodiment shown in FIG. 10 taken along line 12-12.
Figure 13:
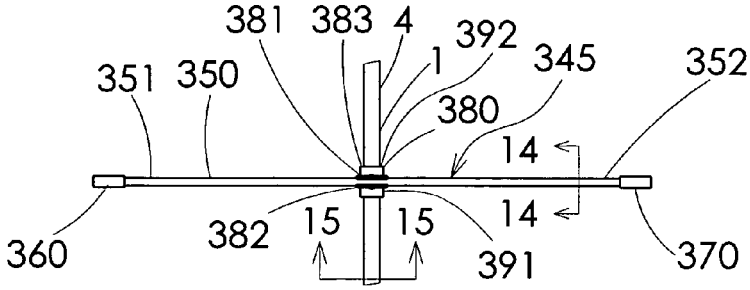
FIG. 13 is a front view of an alternative preferred embodiment of the present invention.
Figure 14:
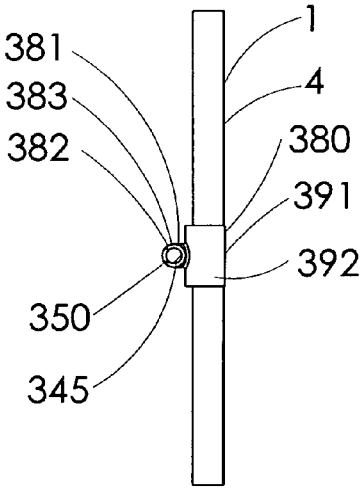
FIG. 14 is a cross-sectional end view of the preferred embodiment shown in FIG. 13 taken along line 14-14.
Figure 15:
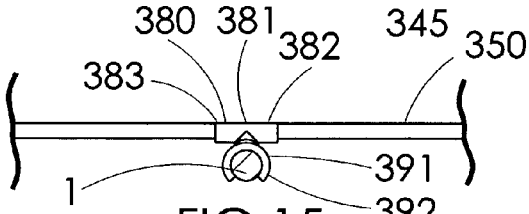
FIG. 15 is a cross-sectional top view of the preferred embodiment shown in FIG. 13 taken along line 15-15.

Looking now to FIGS. 10-12, another alternative preferred embodiment 245 of the present invention is shown. The preferred embodiment has a demonstrator 250 comprising a rod having a first end 251 and a second end 252. The demonstrator 250 is preferably made of a rigid and light-weight material, such as tubular aluminum, wood or plastic. However, it is understood that the demonstrator 250 can be made of other materials without departing from the broad aspects of the present invention. The demonstrator 250 is shown to be generally round in the illustrated embodiment. However, it is understood that the demonstrator 250 could have other profiles, such as rectangular, without departing from the broad aspects of the present invention.

A first positioner is provided and preferably comprises a first cartridge 260. The first cartridge 260 has an interior surface and an exterior surface 262. The interior surface preferably defines an opening through the cartridge 260. The exterior surface 262 is preferably generally circular in profile. However, it is understood that the profile could have different shapes without departing from the broad aspects of the present invention. A selected length of adhesive material 263 is preferably wound around the exterior surface 262 of the cartridge 260. The adhesive material 263 has an adhesive surface 264 that is located on the side of the adhesive material that is away, or remote from, the cartridge 260. The selected length of the adhesive material is long enough to wind around the cartridge 260 at least two times, and preferably is long enough to provide for many revolutions. A worn or used segment, preferably one revolution, of the adhesive material 263 can be removed from the cartridge 260 to expose a fresh segment of the adhesive material 263.

The first cartridge 260 is removably connected to the first end 252 of the demonstrator 250. In this regard, the interior surface of the cartridge 260 is shaped to mate with the first end 251 of the demonstrator 250. The cartridge 260 can be frictionally held in place on the first end 251 of the demonstrator 250. Alternatively, the cartridge 260 could be pinned in place or secured in any other suitable manner.

A second positioner is also provided and comprises a second cartridge 270. The second cartridge 270 has an interior surface and an exterior surface 272. The interior surface preferably defines an opening through the cartridge 270. The exterior surface 272 is preferably generally circular in profile. However, it is understood that the profile could have different shapes without departing from the broad aspects of the present invention. A selected length of adhesive material 273 is preferably wound around the exterior surface 272 of the cartridge 270. The adhesive material 273 has an adhesive surface 274 that is located on the side of the adhesive material that is away, or remote from, the cartridge 270. The selected length of the adhesive material is long enough to wind around the cartridge 270 at least two times, and preferably is long enough to provide for many revolutions. A worn or used segment, preferably one revolution, of the adhesive material 273 can be removed from the cartridge 270 to expose a fresh segment of the adhesive material 273.

The second cartridge 270 is removably connected to the second end 252 of the demonstrator 250. In this regard, the interior surface of the cartridge 270 is shaped to mate with the second end 252 of the demonstrator 250. The cartridge 270 can be frictionally held in place on the second end 252 of the demonstrator 250. Alternatively, the cartridge 270 could be pinned in place or secured in any other suitable manner.

The adhesive material 263 and 273 of the first and second cartridges 260 and 270, respectively, act as stabilizers to fix the demonstrator 250 within the flag.

A stabilizer 280 is provided according to another aspect of the present invention. The stabilizer 280 preferably comprises a hook and eye fabric 281 and 282, respectively. The hook fabric 281 can be secured to the back of the pole using adhesive or other suitable means. The eye fabric 282 can then wrap around the demonstrator 250 and connect to the hook fabric 281 on the back of the pole. It is understood that the eye fabric can alternatively be secured to the pole and the hook fabric can be used to wrap around the demonstrator and pole.

Turning now to the use of this alternative preferred embodiment 245, selected portions of the front surface of a flag can be displayed. Knowing which portions of the flag are to be displayed, the user can determine where to position the demonstrator 250 relative to the pole. The stabilizer 280 fixes the demonstrator 250 in the selected position relative to the pole. The demonstrator 250 remains fixed to the pole until a user selectably removes the stabilizer 280 from the pole by disengaging the hook fabric 281 from the eye fabric 282. The first positioner 260 is sandwiched between two portions of the back surface of the flag. The first positioner 260 is located near the bottom of the flag, and the front surface is draped over first cartridge 260. The adhesive material 263 is useful to keep the flag in this intended orientation. The geometry of the flag over the first positioner 280 can be defined as a downward facing pocket. The second positioner 270 is also sandwiched between two portions of the back surface of the flag. The top of the flag is draped over the second cartridge 270. The geometry of the flag over the second positioner is defined as a folded flag.

Looking now to FIGS. 13-16, a still further alternative preferred embodiment 345 of the present invention is shown. The preferred embodiment has a demonstrator 350 comprising a rod having a first end 351 and a second end 352. The demonstrator 350 is preferably made of a rigid and light-weight material, such as tubular aluminum, wood or plastic. However, it is understood that the demonstrator 350 can be made of other materials without departing from the broad aspects of the present invention. The demonstrator 350 is shown to be generally round in the illustrated embodiment. However, it is understood that the demonstrator 350 could have other profiles, such as rectangular, without departing from the broad aspects of the present invention.

A first positioner is provided and is preferably a first friction cap 360. The friction cap 360 is preferably made of rubber, but other materials can be used without departing from the broad aspects of the present invention. The first friction cap 360 is preferably permanently secured to the first end 351 of the demonstrator 350. The first friction cap 360 preferably has a generally circular profile. However, other profiles could be used without departing from the broad aspects of the present invention.

A second positioner is also provided and is preferably a second friction cap 370. The friction cap 370 is preferably made of rubber, but other materials can be used without departing from the broad aspects of the present invention. The second friction cap 370 is preferably permanently secured to the second end 352 of the demonstrator 350. The second friction cap 370 preferably has a generally circular profile. However, other profiles could be used without departing from the broad aspects of the present invention.

A stabilizer 380 is provided according to another aspect of the present invention. The stabilizer 380 preferably comprises a clamping device 381 having a front portion 382 with a first clamp 383 and a rear portion 391 with a second clamp 392. The first clamp 383 is preferably generally C-shaped, and is resiliently flexible and sized to allow the clamp to selectably engage the demonstrator 350. The second clamp 392 is preferably generally C-shaped, and is resiliently flexible and sized to allow the clamp to selectably engage the pole 1.

Figure 16:
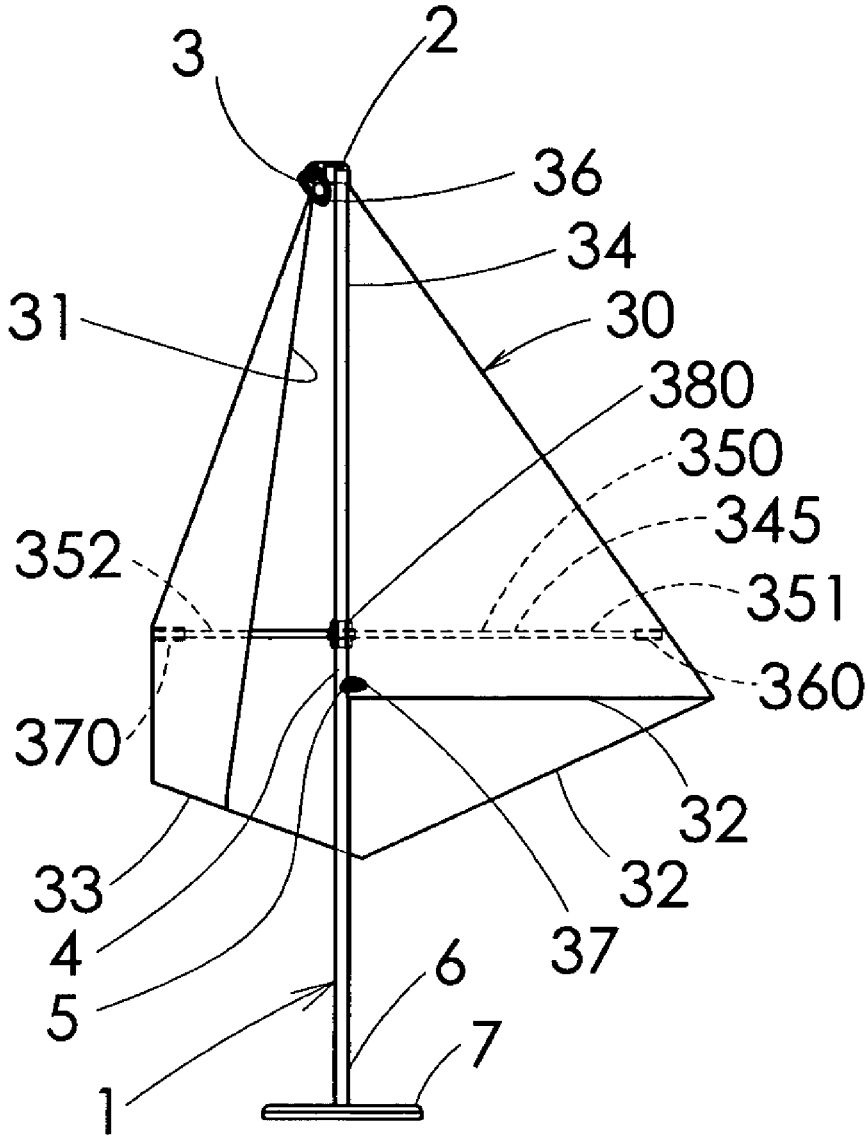
FIG. 16 is a rear view of the preferred embodiment shown in FIG. 13 holding a flag in a selected position.
Figure 17:
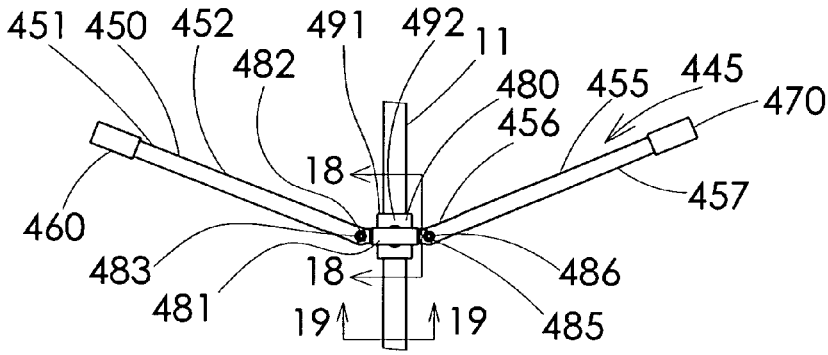
FIG. 17 is a front view of an alternative preferred embodiment of the present invention.
Figure 18:
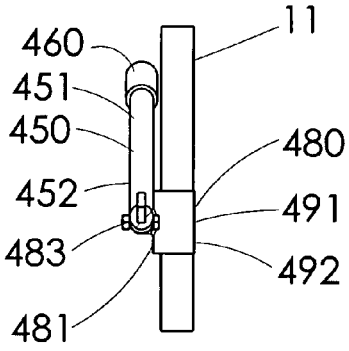
FIG. 18 is a cross-sectional end view of the preferred embodiment shown in FIG. 17 taken along line-18-18.
Figure 19:
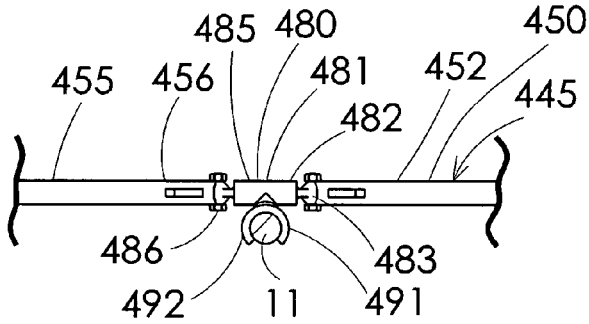
FIG. 19 is a cross-sectional top view of the preferred embodiment shown in FIG. 17 taken along line 19-19.

Turning now to the use of this alternative preferred embodiment 345, and looking particularly at FIG. 16, selected portions of the front surface 38 of a flag 30 can be displayed. In the illustrated embodiment, flag 30 is supported by pole 1. Knowing which portions of the flag 30 are to be displayed, the user can determine where to position the demonstrator 350 relative to the pole 1. The stabilizer 380 fixes the demonstrator 350 in the selected position relative to the pole 1. The demonstrator 350 remains fixed to the pole until a user selectably removes the stabilizer 380. The first positioner 360 is sandwiched between two portions of the back surface 39 of the flag. The first positioner 360 is located near the bottom 32 of the flag 30, and the front surface 38 is draped over the friction cap 360. The geometry of the flag over the first positioner 360 is defined as a downward facing pocket. The second positioner 370 is also sandwiched between two portions of the back surface 39 of the flag. The top 31 of the flag 30 is draped over the second friction cap 370. In this regard, the geometry of the flag 30 over the second positioner is a folded flag. In the illustrated embodiment, the demonstrator 350 is generally perpendicular to the pole 1. However, other orientations of the demonstrator 350 relative the pole 1 are possible. The demonstrator 350 is illustrated to be offset from the pole 1 such that the center of gravity of demonstrator 350 is located remote from the pole. The lowest displayed point of the flag 30 is the bottom right corner of the flag.

Looking now to FIGS. 17-21, a still further alternative preferred embodiment 445 of the present invention is shown. The preferred embodiment has a first demonstrator 450 comprising a rod having a first end 451 and a second end 452. The demonstrator 450 is preferably made of a rigid and light-weight material, such as tubular aluminum, wood or plastic. However, it is understood that the demonstrator 450 can be made of other materials without departing from the broad aspects of the present invention. The demonstrator 450 is shown to be generally round in the illustrated embodiment. However, it is understood that the demonstrator 450 could have other profiles, such as rectangular, without departing from the broad aspects of the present invention.

The preferred embodiment 445 also has a second demonstrator 455. Demonstrator 455 comprises a rod having a first end 456 and a second end 457. The demonstrator 455 is preferably made of a rigid and light-weight material, such as tubular aluminum, wood or plastic. However, it is understood that the demonstrator 455 can be made of other materials without departing from the broad aspects of the present invention. The demonstrator 455 is shown to be generally round in the illustrated embodiment. However, it is understood that the demonstrator 455 could have other profiles, such as rectangular, without departing from the broad aspects of the present invention.

A first positioner is provided and is preferably a first friction cap 460. The friction cap 460 is preferably made of rubber, but other materials can be used without departing from the broad aspects of the present invention. The first friction cap 460 is preferably permanently secured to the first end 451 of the first demonstrator 450. The first friction cap 460 preferably has a generally circular profile. However, other profiles could be used without departing from the broad aspects of the present invention.

A second positioner is also provided and is preferably a second friction cap 470. The friction cap 470 is preferably made of rubber, but other materials can be used without departing from the broad aspects of the present invention. The second friction cap 470 is preferably permanently secured to the second end 457 of the second demonstrator 455. The second friction cap 470 preferably has a generally circular profile. However, other profiles could be used without departing from the broad aspects of the present invention.

A stabilizer 480 is provided according to another aspect of the present invention. Stabilizer 480 comprises a front 481 having a first end 482 and a second end 484. The first end 481 has a pivot 483. The second end 452 of the first demonstrator 450 is selectably pivotally connected to the stabilizer 480 at the pivot 483. The second end 482 has a pivot 484. The first end 456 of the second demonstrator 455 is selectably pivotally connected to the stabilizer 480 at the pivot 484. The stabilizer 480 also has a rear portion 491 with a clamp 492 useful for connecting to a pole 11. The clamp 492 is preferably a generally C-shaped clamp that is resiliently deflectable to allow for connection to the pole 11.

Figure 20:
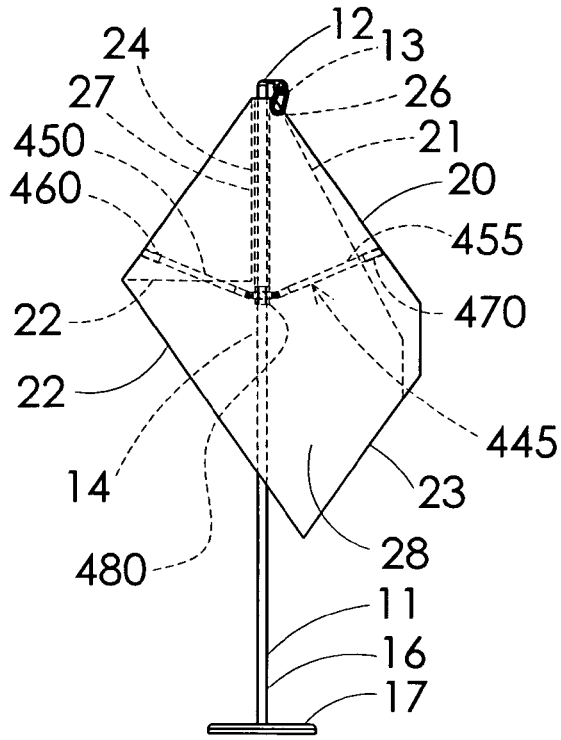
FIG. 20 is a front view of the preferred embodiment shown in FIG. 17 holding a flag in a selected position.
Figure 21:
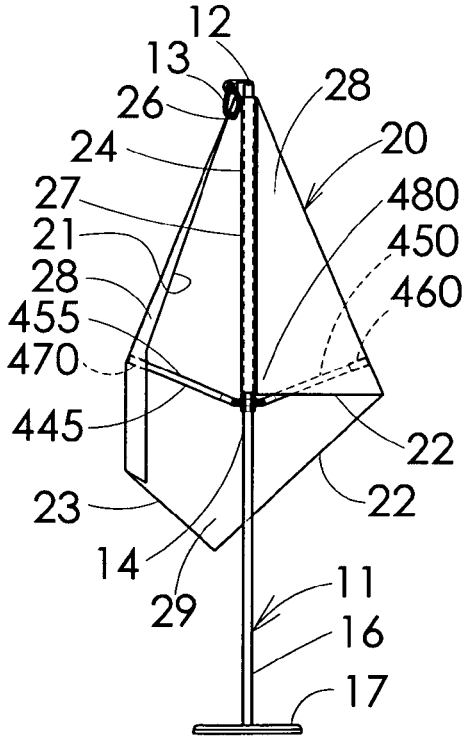
FIG. 21 is a front view of the preferred embodiment shown in FIG. 17 holding an alternative flag in a selected position.

Turning now to the use of this alternative preferred embodiment 445, and looking particularly at FIGS. 20 and 21, selected portions of the front surface 28 of a flag 20 can be displayed. In the illustrated embodiment, flag 20 is supported by pole 11. Knowing which portions of the flag 20 are to be displayed, the user can determine where to position the demonstrator 450 relative to the pole 11. The stabilizer 480 fixes the demonstrator 450 in the selected position relative to the pole 11. The demonstrator 450 remains fixed to the pole until a user selectably removes the stabilizer 480. The first demonstrator 450 is secured in the selected rotated orientation. The first positioner 460 is sandwiched between two portions of the back surface 29 of the flag. The first positioner 460 is located near the bottom 22 of the flag 20, and the front surface 28 is draped over the friction cap 460. The geometry of the flag over the first positioner 460 is defined as a downward facing pocket. The second demonstrator 455 is secured in its selected rotated orientation. The second positioner 470 is also sandwiched between two portions of the back surface 29 of the flag. The top 21 of the flag 20 is draped over the second friction cap 470. In this regard, the geometry of the flag 20 over the second positioner is a folded flag. The lowest displayed point of the flag 20 is the bottom right corner of the flag.

Figure 22:
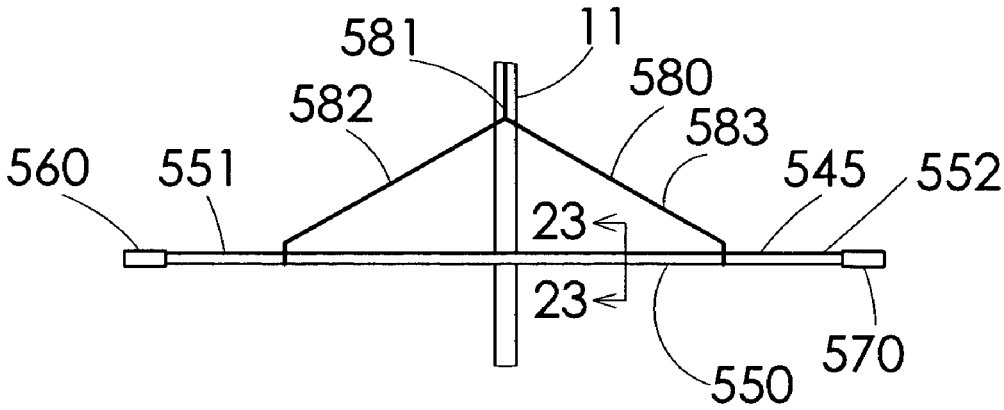
FIG. 22 is a front view of an alternative preferred embodiment of the present invention.
Figure 23:
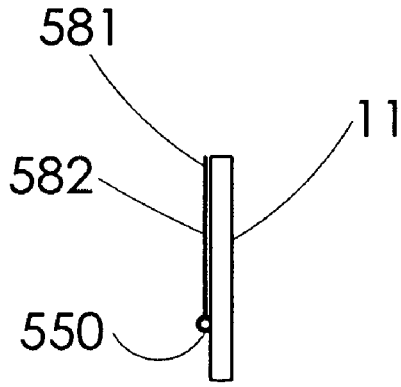
FIG. 23 is a cross-sectional end view of the preferred embodiment shown in FIG. 22 taken along line 23-23.
Figure 24:
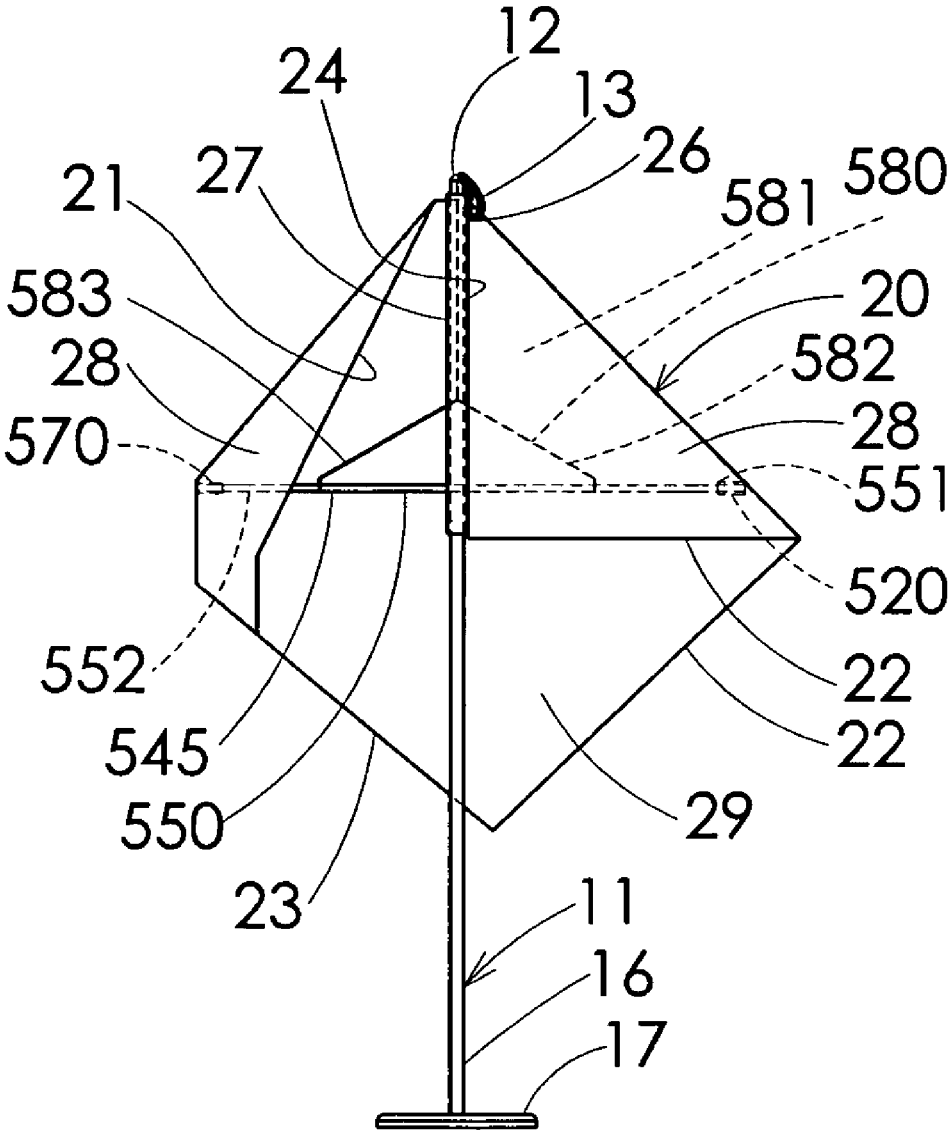
FIG. 24 is a rear view of the preferred embodiment shown in FIG. 22 holding a flag in a selected position.

Looking now to FIGS. 22-24, a still further alternative preferred embodiment 545 of the present invention is shown. The preferred embodiment has a demonstrator 550 comprising a rod having a first end 551 and a second end 552. The demonstrator 550 is preferably made of a rigid and light-weight material, such as tubular aluminum, wood or plastic. However, it is understood that the demonstrator 550 can be made of other materials without departing from the broad aspects of the present invention. The demonstrator 550 is shown to be generally round in the illustrated embodiment. However, it is understood that the demonstrator 550 could have other profiles, such as rectangular, without departing from the broad aspects of the present invention.

A first positioner is provided and is preferably a first friction cap 560. The friction cap 560 is preferably made of rubber, but other materials can be used without departing from the broad aspects of the present invention. The first friction cap 560 is preferably permanently secured to the first end 551 of the demonstrator 550. The first friction cap 560 preferably has a generally circular profile. However, other profiles could be used without departing from the broad aspects of the present invention.

A second positioner is also provided and is preferably a second friction cap 570. The friction cap 570 is preferably made of rubber, but other materials can be used without departing from the broad aspects of the present invention. The second friction cap 570 is preferably permanently secured to the second end 552 of the demonstrator 550. The second friction cap 570 preferably has a generally circular profile. However, other profiles could be used without departing from the broad aspects of the present invention.

A stabilizer 580 is provided according to another aspect of the present invention. The stabilizer 580 preferably comprises a vertical string 581 that is connectable to the top clip 13 of pole 11. The vertical string 581 depends down there from, and splits into two legs 582 and 583. The legs 582 and 583 are connectable to the demonstrator 550. It has been found that two legs are sufficient to hold the demonstrator 550 in a relatively horizontal position, regardless of the distance the center of gravity of the demonstrator moves away from the pole 11.

Turning now to the use of this alternative preferred embodiment 345, and looking particularly at FIG. 24, selected portions of the front surface 28 of a flag 20 can be displayed. In the illustrated embodiment, flag 20 is supported by pole 11. Knowing which portions of the flag 20 are to be displayed, the user can determine where to position the demonstrator 550 relative to the pole 11. The stabilizer 580 fixes the demonstrator 550 in the selected position relative to the pole 11. The demonstrator 550 remains fixed to the pole until a user selectably removes the stabilizer 580. The first positioner 560 is sandwiched between two portions of the back surface 29 of the flag. The first positioner 560 is located near the bottom 22 of the flag 20, and the front surface 28 is draped over the friction cap 560. The geometry of the flag over the first positioner 560 is defined as a downward facing pocket. The second positioner 570 is also sandwiched between two portions of the back surface 29 of the flag. The top 21 of the flag 20 is draped over the second friction cap 570. In this regard, the geometry of the flag 20 over the second positioner is a folded flag. In the illustrated embodiment, the demonstrator 550 is generally perpendicular to the pole 11. However, other orientations of the demonstrator 550 relative the pole 11 are possible. The lowest displayed point of the flag 20 is the bottom right corner of the flag.

Thus it is apparent that there has been provided, in accordance with the invention, a flag display apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for use with a flag having a front and a back and that is supported by a pole, the apparatus comprising:

a demonstrator having a first end and a second end;

a first cartridge removably connected to said first end and having a first selected length of a material with a segment having an exposed adhesive surface, said first selected amount of material being contained by said first cartridge; and a second cartridge removably connected to said second end and having a second selected length of said material with a segment having an exposed adhesive surface, said second selected amount of material being contained by said second cartridge, wherein said demonstrator is supported by the flag by adhesively being connected to selected portions of the back of the flag to display selected portions of the front of the flag, wherein said segment of said first selected amount of material being contained by said first cartridge is removable to expose a fresh segment of said first selected amount of material, and said segment of said second selected amount of material being contained by said second cartridge is removable to expose a fresh segment of said second selected amount of material, and wherein said fresh segment of said first selected amount of material and said fresh segment of said second selected amount of material are used to connect to the flag.

2. The apparatus of claim 1 wherein:

said first selected length of material is wound around said first cartridge and said segment of said first selected length of material equals approximately the length of one revolution of said first selected length of material around said first cartridge; and said second selected length of material is wound around said second cartridge and said segment of said second selected length of material equals approximately the length of one revolution of said second selected length of material around said second cartridge.

3. The apparatus of claim 1 wherein said first cartridge and said second cartridge are generally circular in profile.

4. The apparatus of claim 1 wherein said apparatus further comprises a stabilizer for connecting said demonstrator to the pole.

5. The apparatus of claim 4 wherein:

said demonstrator has a center of gravity generally equidistant between said first end and said second end;

said stabilizer rigidly connects said demonstrator to the pole; and said demonstrator is generally perpendicular to the pole regardless of the distance that said center of gravity of said demonstrator is located from said pole.

6. The apparatus of claim 4 wherein said stabilizer comprises a clamp for connecting said stabilizer to the pole.

7. The apparatus of claim 4 wherein said demonstrator comprises two portions, wherein each of said portions are rotatably connected to said stabilizer.

8. The apparatus of claim 1 wherein said demonstrator has an adjustable length.

9. An apparatus for use with a flag having a front and a back and that is supported by a pole, the apparatus comprising:

a demonstrator having a first end and a second end;

a first positioner at said first end of said demonstrator, said first positioner comprising a first cartridge having a first selected length of a material with a segment having an exposed adhesive surface, said first selected amount of material being contained by said first cartridge;

a second positioner at said second end of said demonstrator, said second positioner comprising a second cartridge having a second selected length of said material with a segment having an exposed adhesive surface, said second selected amount of material being contained by said second cartridge; and a stabilizer supporting said demonstrator in a desired position relative to the pole, wherein said flag is held in an intended orientation defining a pocket and a folded portion of said demonstrator, and wherein said one segment of said first selected amount of material is used to connect to said pocket and said one segment of said second selected amount of material is used to connect to said folded portion.

10. The apparatus of claim 9 wherein said stabilizer comprises a first clamp for connecting to the pole and a second clamp for connecting to said demonstrator.

11. The apparatus of claim 9 wherein:

the pole has a top and a bottom, wherein a clip is at the top of the pole; and said stabilizer comprises a string supported by the clip at the top of the pole, said string having a first leg and a second leg, wherein each of said first leg and said second leg supports said demonstrator in the desired position relative to the pole.

12. The apparatus of claim 9 wherein said stabilizer is wound around said demonstrator and the pole.

13. The apparatus of claim 9 wherein:

said segment of said first selected length of material equals approximately the length of one revolution of said first selected length of material around said first cartridge; and said segment of said second selected length of material equals approximately the length of one revolution of said second selected length of material around said second cartridge.

14. The apparatus of claim 9 wherein said stabilizer holds said demonstrator generally perpendicular to the pole.

15. The apparatus of claim 9 wherein the intended orientation of the flag comprises displaying a selected portion of the front of the flag in a plane parallel to a plane defined by the demonstrator and the pole.

16. An apparatus for use with a flag having a front and a back and that is supported by a pole for displaying a selected portion of the front of the flag, the apparatus comprising:

a demonstrator having a first end and a second end, said demonstrator defining a length between said first end and said second end, said length being adjustable;

a first positioner at said first end of said demonstrator, said first positioner comprising a first cartridge having a first selected length of a material with a segment having an exposed adhesive surface, said first selected amount of material being contained by said first cartridge; and a second positioner at said second end of said demonstrator said second positioner comprising a second cartridge having a second selected length of said material with a segment having an exposed adhesive surface, said second selected amount of material being contained by said second cartridge;

wherein said flag is held in an intended orientation on said demonstrator and in a plane parallel to a plane defined by the demonstrator and the pole, and wherein the intended orientation of the flag defines the selected portion of the front of the flag to be displayed;

wherein said segment of said first selected amount of material and said segment of said second selected amount of material are used to connect to the flag to hold the flag in the desired position, and wherein changing the selected length of said demonstrator changes the intended orientation of the flag.

17. The apparatus of claim 16 further comprising a stabilizer for fixing the position of said demonstrator relative to the pole.

18. The apparatus of claim 16 wherein:

the intended orientation of the flag is defined as a pocket and a folded portion;

said first positioner is received within the pocket of the flag; and said second positioner is received within said folded portion of the flag.

* * * * *